United States Patent [19]

Kampf

[11] Patent Number: 4,949,911

[45] Date of Patent: Aug. 21, 1990

[54] WINDING CROSSBEAM

[75] Inventor: Eberhard Kampf, Wiehl, Fed. Rep. of Germany

[73] Assignee: Kampf GmbH & Co. Maschinenfabrik, Fed. Rep. of Germany

[21] Appl. No.: 831,136

[22] Filed: Feb. 18, 1986

[30] Foreign Application Priority Data

Feb. 27, 1985 [DE] Fed. Rep. of Germany ..... 3506867

[51] Int. Cl.[5] ..... B65H 18/04

[52] U.S. Cl. ..... 242/67.1 R; 242/68.4

[58] Field of Search ..... 242/67.1 R, 58.6, 56.2, 242/68.4, 56.4, 65; 384/549

[56] References Cited

U.S. PATENT DOCUMENTS 3,057,571 10/1962 Aaron et al. ..... 242/58.6

3,222,004 12/1965 Crowe ..... 242/65 X 3,539,127 11/1970 Grawey ..... 242/56.2

4,118,180 10/1978 Bliemeister ..... 384/549 X 4,192,491 3/1980 Riegler et al. ..... 384/549 X

*Primary Examiner*—John M. Jillions

*Attorney, Agent, or Firm*—Mason, Kolehmainen, Rathburn & Wyss

[57] ABSTRACT

A winding crossbeam on a winding machine, which is pivotally-mounted about a pivoting axis between two side shields of the winding machine and which slidably and adjustably receives a plurality of winding stations. The technical problem is the suppression of the bending of long winding crossbeams. The winding crossbeam comprises in the central region concentrically to the pivoting axis a circular segmental arc. Carrying rollers are provided for the supporting of the circular segmental arc.

6 Claims, 2 Drawing Sheets

WINDING CROSSBEAM

BACKGROUND OF THE INVENTION

1. Field of the Invention

The invention relates to a winding crossbeam on a winding machine, which is pivotally mounted about a pivoting axis between two side shields of the winding machine and which slidably and adjustably receives a plurality of winding stations.

2. Field of the Prior Art

Such a winding crossbeam is provided normally as a hollow beam. The winding stations are displaceable in the longitudinal direction of the winding crossbeam and thus transversely to the working direction of the winding machine and are adjustable to different roll widths. The winding stations may be moved also into parking positions outside the working range. That means that the winding crossbeam is considerably longer than the working width of the winding machine. The working width of a winding machine may be up to 8 m, and more. From that a length of the winding crossbeam of up to 10 m, and considerably more, results. Even in the case of a stable hollow beam the load will effect bending in the central region, exceeding the admissible amount considerably. The bending may amount to several tenths millimeters. Actually, the bending is a function to the third power of the length of the winding crossbeam.

SUMMARY OF THE INVENTION

An object of the invention is the compensation or suppression of the bending of long winding crossbeams.

According to the invention this object is solved in that the winding crossbeam comprises in the central region concentrically to the pivoting axis a circular segment arc and that carrying rollers are provided for the supporting of the circular segmental arc.

The invention differs from the prior art in so far as by the supporting of the winding crossbeam in the central portion a bending is avoided. Even in the case of long crossbeams a precise alignment is guaranteed.

A particularly secure supporting is reached in that the cylinder segment-shaped outer surface of the circular segmental arc is provided as a bearing surface.

A reliable reception of the load in the supporting range is secured in that the carrying rollers are arranged in a pedestal.

Possibilities for adaptability, to a large extent, to modified arrangement and assembly conditions of the winding machine are possible in that the pedestal is provided also as a movable pedestal.

BRIEF DESCRIPTION OF THE DRAWINGS

One embodiment of the invention will be described in the following with reference to the accompanying drawings, wherein.

DESCRIPTION OF THE PREFERRED EMBODIMENT

Figure 1:
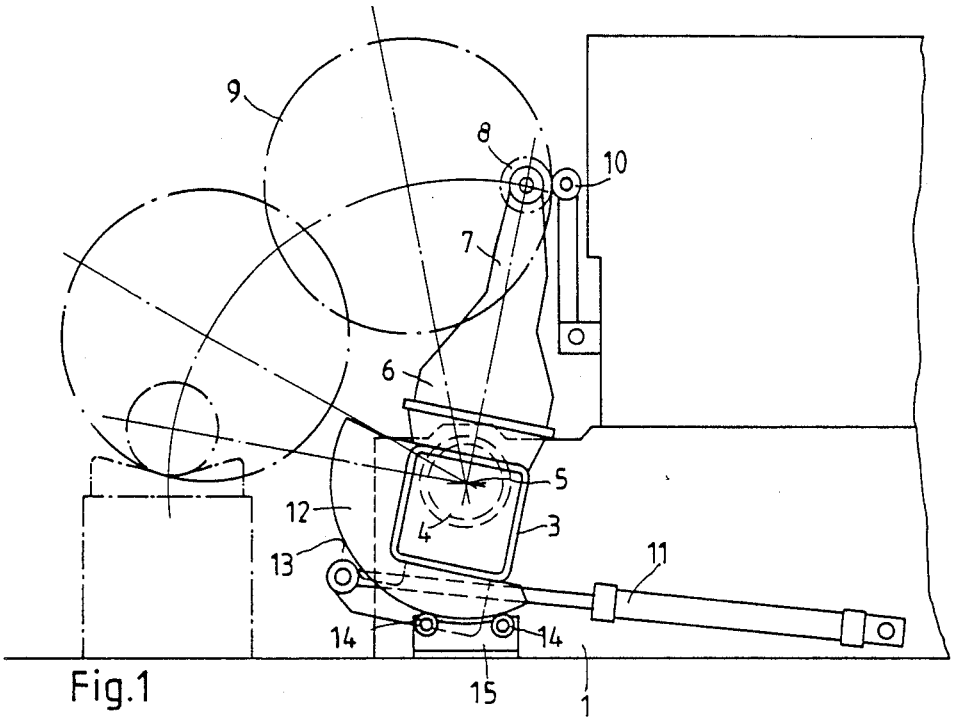
FIG. 1 is a section through a winding crossbeam with a schematical representation of different parts of the winding machine.
Figure 2:
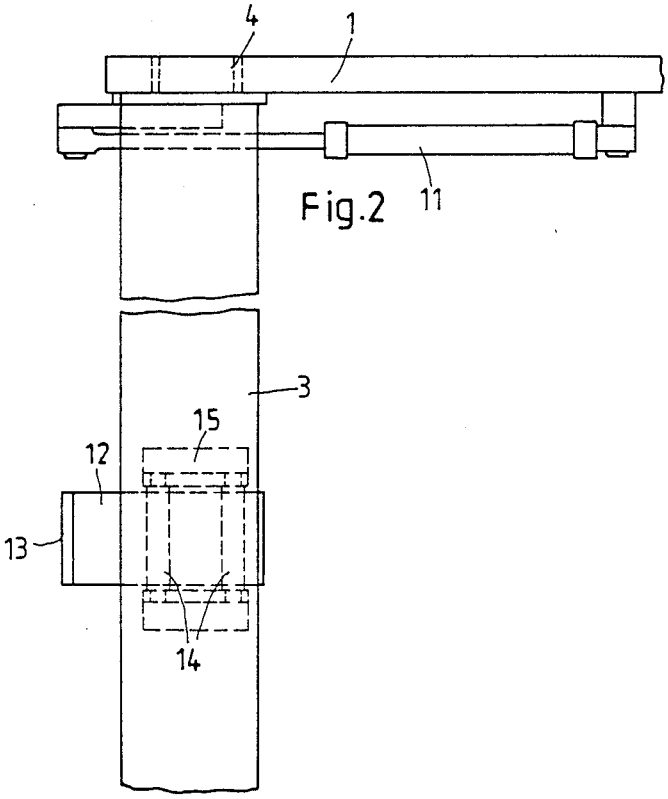
FIG. 2 is a top view in regard to FIG. 1, whilst
Figure 3:
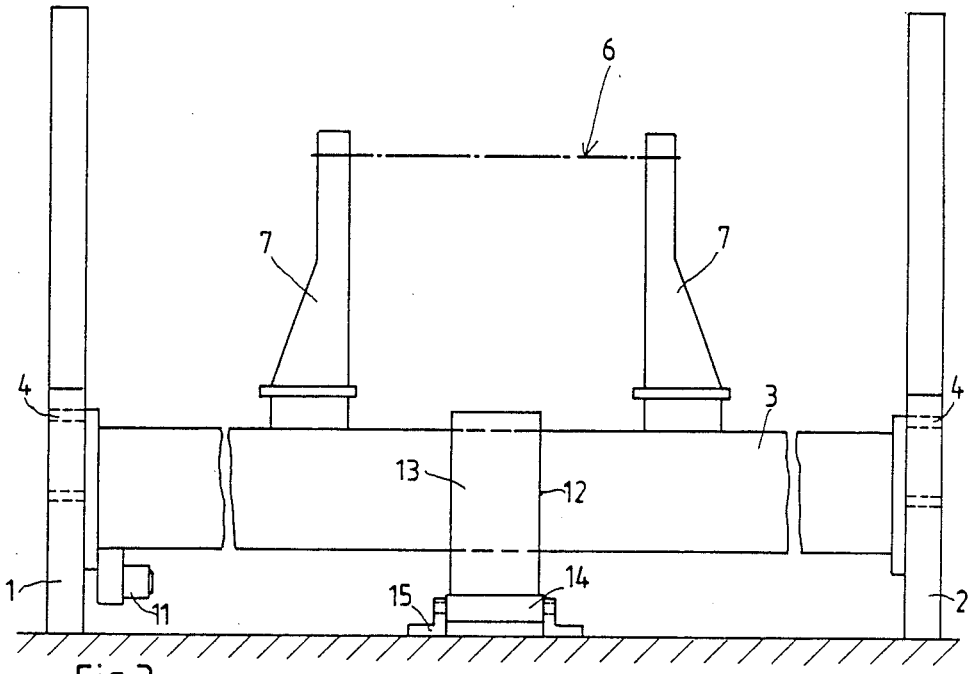
FIG. 3 shows a side view in regard to FIG. 1.

Regarding the winding machine, in the Figures side shields 1 and 2 are shown, between which the working rollers, slitting rollers, deflection rollers, and the like, of the winding machine are supported. These rollers are not shown. The winding machine comprises a plurality of winding crossbeams 3, only one of which being shown. The winding crossbeam 3 is a hollow beam having a rectangular cross-section, which is supported with journal studs 4 pivotably about a pivoting axis 5 in the side shields 1 and 2. On the winding crossbeam winding stations 6 are arranged, winding cores 8 being clampable between the winding arms 7 thereof. The drive for the winding cores 8 is not shown. On the winding cores 8 rolls 9 are formed in the usual manner. A pressing roller 10 cooperates with each winding core.

The winding crossbeam 3 is pivotable about the pivoting axis 5 by means of a cylinder unit 11. It is possible to provide a cylinder unit 11 on one end of the winding crossbeam 3 in the manner as shown or also on both ends. The cylinder unit 11 renders possible a swivelling of the winding crossbeam in accordance with the increase of the rolls as well as a swivelling of the winding stations in the parking position. The specific possibilities for swivelling are indicated in FIG. 1 by dot-dash lines.

In the case of long winding crossbeams 3 for winding machines with large working width a circular segmental arc 12 is provided in the centre of the winding crossbeam 3. The circular segmental arc 12 has a cylinder segment-shaped outer surface 13 as running or bearing surface. This cylinder segment-shaped outer surface 13 is supported on carrying rollers 14 which are supported in a pedestal 15. The pedestal 15 is provided as a stationary or as a movable pedestal. That depends substantially upon the design of the winding machine.

I claim the following:

1. The winding crossbeam assembly having a plurality of winding stations comprising:

a pair of spaced apart side shields;

an elongated non-circular winding crossbeam pivotally connected between said side shields;

a circular arc segment for peripheral engagement of at least a portion of said winding crossbeam, said circular arc segment providing a circular support surface for said winding crossbeam;

a support pedestal; and a plurality of support rollers rotatably carried by said support pedestal for supporting said circular arc segment.

2. A winding crossbeam assembly as recited in claim 1 wherein said winding crossbeam has a generally rectangular cross section.

3. A winding crossbeam assembly as recited in claim 1 wherein said winding crossbeam comprises an elongated hollow beam.

4. A winding crossbeam assembly as recited in claim 1 further including actuator means for rotating said winding crossbeam about its pivot axis.

5. A winding crossbeam assembly as recited in claim 4 wherein said actuator means comprises a reciprocating cylinder.

6. A winding crossbeam assembly as recited in claim 1 wherein said support pedestal is slidably mounted in said winding crossbeam assembly.

* * * * *